US006123523A

United States Patent [19]

Cooper

[11] Patent Number: 6,123,523

[45] Date of Patent: Sep. 26, 2000

[54] GAS-DISPERSION DEVICE

[76] Inventor: Paul V. Cooper, 11247 Lake Forest Dr., Chesterland, Ohio 44026

[21] Appl. No.: 09/152,168

[22] Filed: Sep. 11, 1998

[51] Int. Cl.[7] ..... F04B 17/00; F04B 35/04

[52] U.S. Cl. ..... 417/424.1; 417/423.3

[58] Field of Search ..... 75/68 R, 708, 75/93; 222/596; 266/214, 217; 417/424.1, 238, 423.3

[56] References Cited

U.S. PATENT DOCUMENTS

| | | | |
|---|---|---|---|
| 4,052,199 | 10/1977 | Mangalick | 75/68 R |
| 4,091,970 | 5/1978 | Kimiyama et al. | 222/596 |
| 4,169,584 | 10/1979 | Mangalick | 266/214 |
| 4,351,514 | 9/1982 | Koch | 266/217 |
| 5,330,328 | 7/1994 | Cooper | 417/424.1 |
| 5,468,280 | 11/1995 | Areaux | 75/708 |
| 5,509,791 | 4/1996 | Turner | 417/238 |
| 5,685,701 | 11/1997 | Chandler et al. | 417/424.1 |
| 5,944,496 | 8/1999 | Cooper | 417/423.3 |
| 5,993,728 | 11/1999 | Vild | 266/217 |

*Primary Examiner*—Teresa Walberg
*Assistant Examiner*—Leonid Fastovsky
*Attorney, Agent, or Firm*—David E. Rogers; Michael A. Lechter; Squire, Sanders & Dempsey

[57] ABSTRACT

A device for dispersing gas into molten metal, the device comprising: (1) a pump having: (a) a pump base including a pump chamber and a discharge, (b) a motor, (c) a motor shaft connected to the motor, (d) a rotor shaft connected to the motor shaft by a coupling and (e) a rotor fastened to the end of the rotor shaft opposite the motor shaft, the rotor shaft positioned in the pump chamber. The motor shaft and rotor shaft each have gas-transfer passages and the rotor preferably includes openings to transfer gas from the rotor-shaft passage into the pump chamber. The pump generates a stream of molten metal traveling through the discharge. Gas is introduced into the motor shaft passage and passes into the rotor shaft passage where it is transferred to the rotor and ultimately escapes through the openings in the rotor and into the pump chamber. As the rotor turns it mixes the gas and the molten metal and this mixture travels through the entire length of the pump discharge. Optionally, a metal-transfer conduit may extend from the discharge.

30 Claims, 15 Drawing Sheets

GAS-DISPERSION DEVICE

FIELD OF THE INVENTION

The present invention relates to a device and method for releasing gas into molten metal and, in particular, for releasing gas directly into a pump chamber where it is mixed into the molten metal by the action of the rotor and is dispersed in the molten metal throughout the entire length of the pump discharge.

BACKGROUND OF THE INVENTION

When smelting and purifying metals, gas is sometimes introduced into molten metal to remove impurities. Specifically, when processing molten aluminum, it is desirable to remove dissolved gases, particularly hydrogen, and to remove dissolved metals, particularly magnesium. Those skilled in the art refer to removing dissolved gas from molten aluminum as "degassing,"and refer to removing magnesium as "demagging." Nitrogen, argon or freon is generally released into molten metal for degassing purposes while chlorine gas is generally used for demagging.

When demagging or degassing aluminum, gas is released into a quantity of molten aluminum, this quantity generally being referred to as a bath of molten aluminum. The bath is usually contained within the walls of a reverbatory furnace. The present invention can be used for demagging or degassing or any application wherein gas is released into molten metal.

When demagging aluminum, chlorine is released into the bath and bonds, or reacts, with magnesium wherein each pound of magnesium reacts with approximately 2.92 pounds of chlorine to form magnesium chloride ($MgCl_2$). Several methods for introducing chlorine into a molten aluminum bath are disclosed in the prior art. For example, it is known to introduce a flux containing chlorine into the bath, rather than introducing chlorine gas. Another method utilizes a gas-injection system including a pump having a discharge, a metal-transfer conduit attached to and extending from the discharge and a gas-injection conduit connected to the top of, and extending into, the metal-transfer conduit. Molten aluminum is pumped through the metal-transfer conduit and gas is injected through the gas-injection conduit into the upper portion of the metal-transfer conduit.

Other prior art includes: (a) a molten metal pump and gas-injection apparatus whereby gas is introduced through a tube into a passage and is released into molten metal entering the pump inlet; (b) a gas-treatment apparatus comprising: (i) a purification device, which is immersed in a molten metal bath contained within a furnace, and (ii) a decanting and degassing tank located outside of the bath; and (c) U.S. Pat. No. 5,662,725 to Cooper entitled "System And Device For Removing Impurities From Molten Metal," which discloses an apparatus that releases gas into the bottom or sides of a moving molten metal stream so as to better disperse the gas within the stream (the disclosure of U.S. Pat. No. 5,662,725 is incorporated herein by reference).

Specific examples of prior-art devices are disclosed in U.S. Pat. No. 3,650,730 to Derham et al., U.S. Pat. No. 3,767,382 to Bruno et al., U.S. Pat. No. 4,169,584 to Mangalick, U.S. Pat. No. 4,351,314 to Koch, U.S. Pat. No. 4,003,560 to Carbonnel, and U.S. Pat. No. 5,203,681 to Cooper.

One problem with the known gas-injection or gas-release devices (hereinafter collectively referred to as gas-release devices) is that they normally extend into either (a) a molten metal stream travelling through a metal-transfer device, such as a pump discharge or a metal-transfer conduit extending from the discharge, or (b) a flowing molten metal stream in the open molten metal bath. When the gas is introduced into any such molten metal stream it is swept downstream and the gas and molten metal are only confined in an enclosed space over a relatively short distance. Another problem with some of these devices is that they release gas in large bubbles near the inside, upper surface of a metal-transfer device. The gas becomes mixed with the molten metal only through the turbulent action of the flowing molten metal. Because of its buoyancy, much of the gas travels along the top of the metal-transfer device and never mixes with the molten metal.

Removing contaminant gases (known as degassing), such as hydrogen, dissolved in aluminum is usually done in an open metal bath separate and downstream from the charging furnace where the gas-injection or gas-release devices described above are used to demag the aluminum. Degassing is accomplished by the use of a rotary degasser of which there are several designs known to those skilled in the art. Some problems with rotary degassers are that they do not: (1) circulate the molten metal through an enclosed space such as a metal-transfer device, and (2) release gas into a defined stream of molten metal; instead, they release gas into the bottom of the molten metal bath. In addition to removing dissolved contaminant gases, such as hydrogen, degassing removes some solid impurities, such as oxides and salts, sodium fluoride, aluminum fluoride and other fluorides, which may be present in the molten metal suspension in the presence of dissolved hydrogen.

FIGS. 1A–1D represent known methods of releasing gas into (a) a metal-transfer device extending from a pump chamber, or (b) a molten metal stream exiting a metal-transfer device. FIG. 1A shows a pump casing C1 having a pump chamber CH1, a discharge D1 and a gas-release device G1 positioned in discharge D1. Gas (shown as small circles or bubbles) exits G1 into discharge D1 and is dispersed into the molten metal stream. FIG. 1B shows a pump casing C2 having a pump chamber CH2, a discharge D2 and a gas-release device G2 positioned in discharge D2. A metal-transfer conduit MC2 extends from discharge D2. Gas exits G2 into discharge D2 and is dispersed into the molten metal stream. The addition of metal-transfer conduit MC2 increases the distance and time that the metal and gas are confined in an enclosed space. FIG. 1C shows a pump casing C3 having a pump chamber CH3 and a discharge D3. A gas-release device G3 is positioned immediately outside of discharge D3 and releases gas into the molten metal stream exiting discharge D3. FIG. 1D shows a pump casing C4 that includes a pump chamber CH4 and a discharge D4. A metal-transfer conduit MC4 extends from discharge D4. A gas-release device G4 extends into metal-transfer conduit MC4 and releases gas therein. The gas mixes with the metal stream moving through conduit MC4. For each of these known methods, the gas and metal are either dispersed (a) throughout only part of the length of the metal-transfer device (or the combined length of the two metal-transfer devices for a structure such as the one shown in FIG. 2), or (b) not confined at all within an enclosed space.

As will be appreciated by those skilled in the art, the greater the dispersion of gas within the molten metal stream, and/or the longer the gas and metal arc confined, the greater the reaction between the impurities in the metal and the gas.

Improving the efficiency of the demagging and/or degassing process is highly desirable. It reduces material costs because less gas is used. Furthermore, chlorine gas that does not bond with magnesium to form $MgCL_2$ either bonds with aluminum to form aluminum trichloride, an undesirable contaminant, or rises to the top of the molten metal bath and escapes into the atmosphere, where it is an undesirable pollutant. If dissolved contaminant gases are not removed, the resulting aluminum products will contain entrapped gas forming small cavities or pockets. Products formed with these small gas pockets are undesirable because they may have uneven surfaces, contain holes or lack structural integrity.

SUMMARY OF THE INVENTION

The present invention solves these and other problems by providing a gas-dispersion device and method whereby gas is released directly into the pump chamber where it is thoroughly mixed into the molten metal by the action of the rotor, and the mixture of metal and gas then moves through the entire length of a confined space defined by a metal-transfer device, such as a pump discharge and/or metal-transfer conduit. Some advantages of this device and method are: (1) longer reaction time of the gas and molten metal, and (2) more thorough gas dispersion because of action of the rotor. The present invention can be used to demag or degas molten aluminum (or to perform both operations simultaneously), or in any operation where gas is released into molten metal.

The improved gas-dispersion device of the present invention is preferably a pump comprising: (a) a motor; (b) a pump base including a pump chamber, at least one inlet (at either the top or bottom of the pump chamber) and a discharge; (c) a motor drive shaft (or motor shaft); (d) a rotor drive shaft (or rotor shaft) having a first end and a second end, with the first end coupled to the motor drive shaft, and (e) a rotor connected to the second end of the rotor shaft. Preferably, the motor shaft and rotor shaft each include a passage through which gas can be transferred. A gas source is provided that supplies gas to the motor shaft passage. The gas is transferred from the motor shaft passage to the rotor shaft passage and escapes through the second end of the rotor shaft into the pump chamber. Preferably, the rotor includes openings that communicate with the passage in the rotor shaft, and gas moves from the passage in the rotor shaft into these openings and is released therethrough into the pump chamber. Alternatively, the gas can be released at the end of the rotor shaft and escape from underneath the rotor into the pump chamber. In either case, the rotation of the rotor mixes the gas and the metal and this mixture travels through the discharge. Optionally, a metal-transfer conduit is attached at the end of the discharge to increase the time the gas and molten metal are confined.

Some aspects of the improved device and method are generally illustrated in FIGS. 1E and 1F. FIG. 1E shows a pump casing C5 having a pump chamber CH5 and a discharge D5. A gas-release device G5 releases gas directly into pump chamber CH5 where the action of the rotor (not shown) mixes the gas and metal. This mixture then travels throughout the entire length of discharge D5. FIG. 1F shows a pump casing C6 having a pump chamber CH6 and discharge D6. A metal-transfer conduit MC6 extends from the end of discharge D6. A gas-release device G6 releases gas directly into pump chamber CH6 where the action of the rotor (not shown) mixes the gas and metal. This mixture then travels throughout the entire length of discharge D6 and metal-transfer conduit MC6.

Also enclosed herein are specific rotor (also called an impeller or impeller block) configurations that may be used in the practice of the invention.

DETAILED DESCRIPTION OF A PREFERRED EMBODIMENT

Figure 2:
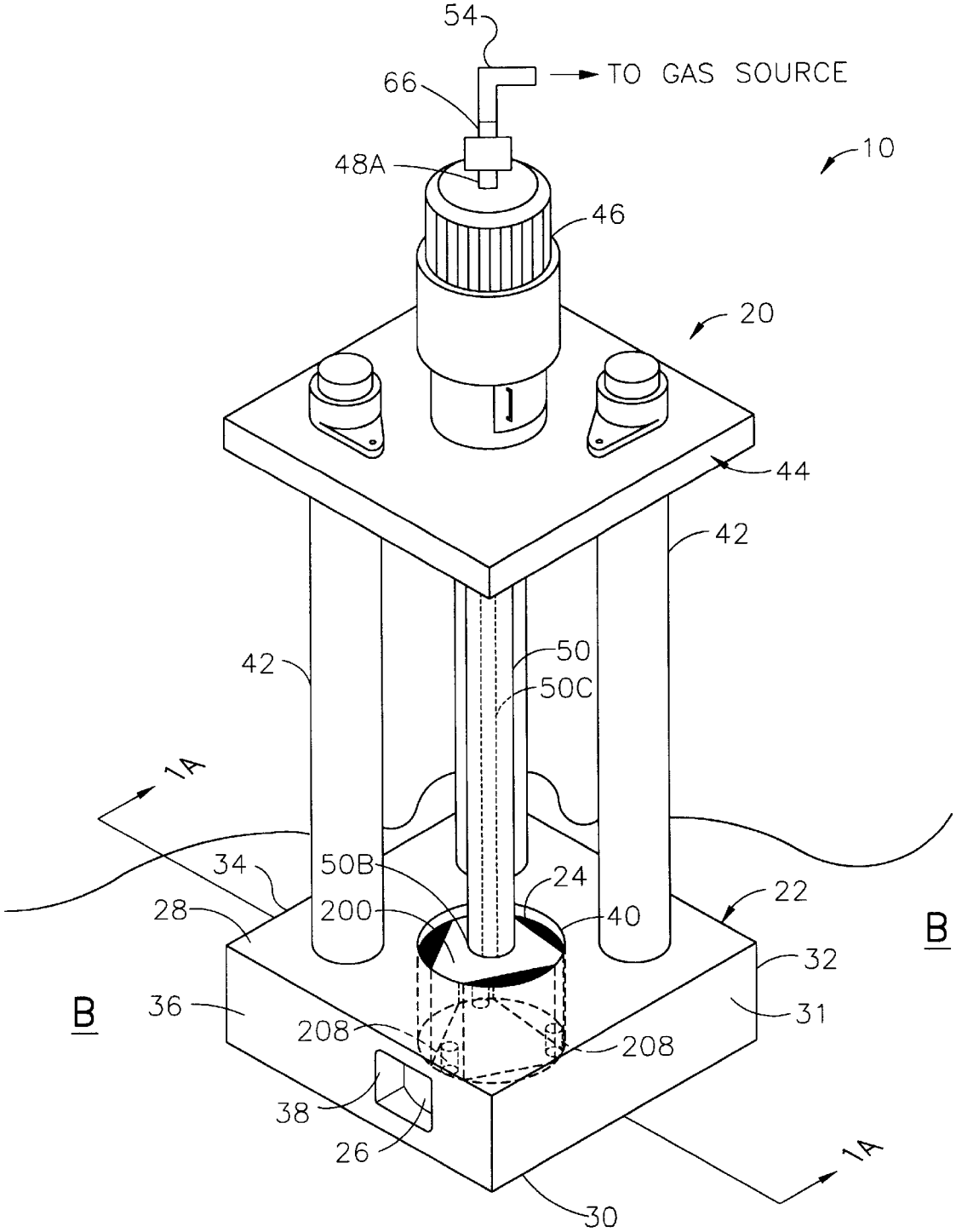
FIG. 2 is a perspective view of a gas-dispersion device according to the invention.

Referring now to the drawings where the purpose is to illustrate and describe a preferred embodiment of the invention, and not to limit same, FIG. 2 shows a gas-dispersion device 10 in accordance with the present invention. Device 10 is an apparatus for mixing gas with molten metal and includes a pump 20 comprising a motor shaft 48, a rotor shaft 50, a coupling 100 and a rotor 200.

Pump 20 is specifically designed for operation in molten metal furnaces or in any environment in which molten metal is to be pumped. Pump 20 can be any structure or device for pumping or otherwise moving molten metal whereby the metal is moved preferably at a velocity of at least 5 ft./sec. and most preferably at a velocity of 10 ft./sec. or faster to form a stream or flow of molten metal. The preferred minimum velocity of 5 ft./sec. is required so that the gas released into the moving molten metal stream is swept into the stream instead of simply rising vertically through the stream. Thus, a higher velocity improves the interaction between the gas and the molten metal. A preferred pump 20 is disclosed in U.S. Pat. No. 5,203,681 to Cooper entitled "Submersible Molten Metal Pump," the disclosure of which is incorporated herein by reference.

Figure 3:
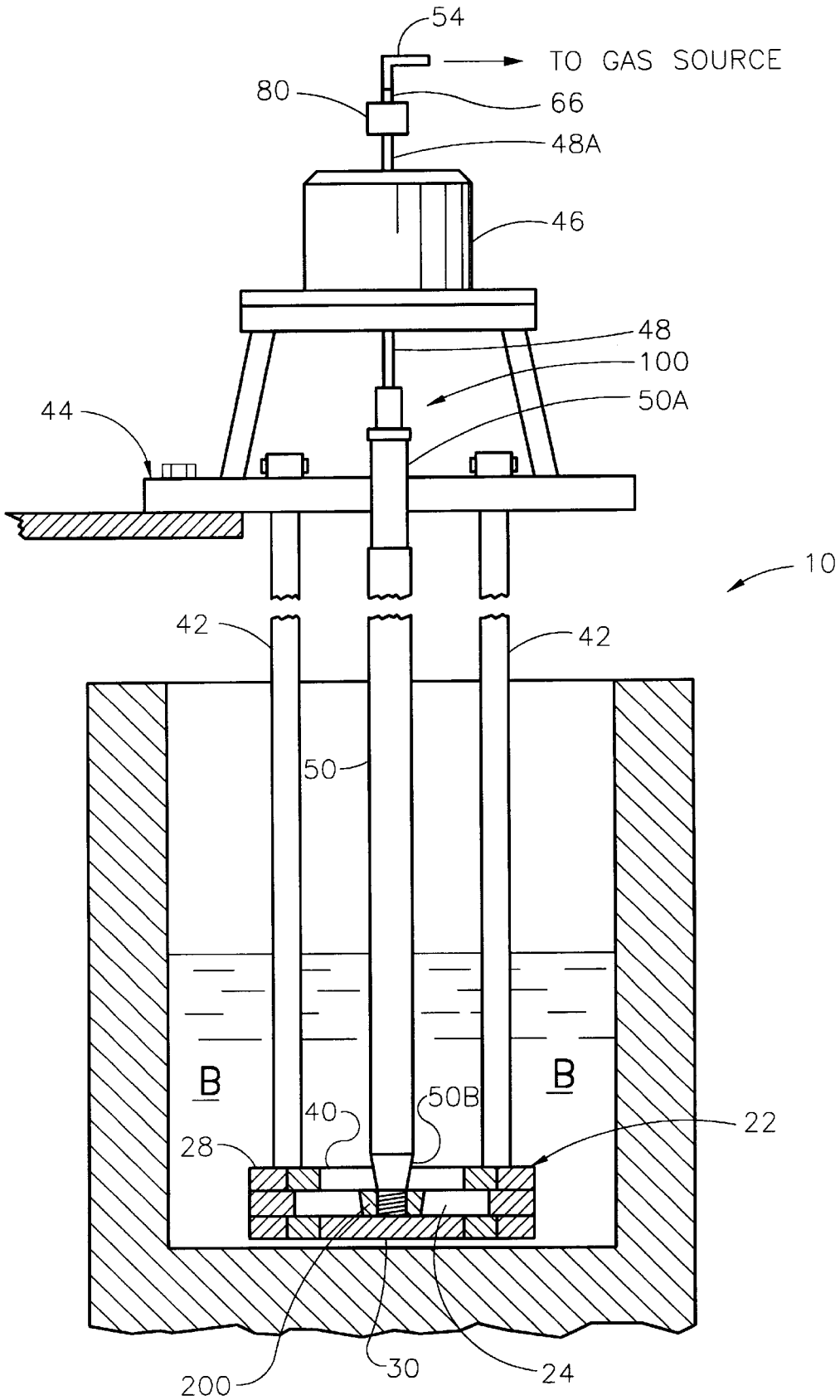
FIG. 3 is a partial, cross-sectional, front view of the device shown in FIG. 2 with the motor cooling shroud removed.

Basically, the preferred embodiment, which is best seen in FIGS. 2 and 3, of pump 20 has a pump base, or housing, 22 submersible in a molten metal bath B within a furnace or well. Pump base 22 preferably includes a generally cylindrical pump chamber 24 (although chamber 24 may include a volute or be of any shape) having a tangential discharge 26, a top surface 28, a bottom surface 30, sides 31, 32, 34 and 36, an outlet 38, an inlet 40 in top surface 28 (although the inlet could be formed in bottom surface 30 of base 22, or base 22 could have two inlets, one in top surface 28 and one in the bottom surface 30), and rotor, or impeller, 200 (which can be any style of impeller, such as a bird-cage impeller or perforate or imperforate impeller of any shape). Support posts 42 extend from base 22 to a super structure 44 of the pump thus supporting super structure 44.

A motor 46 is mounted on super structure 44 and has a motor drive shaft 48 (best seen in FIGS. 3, 4, 4B and 7) extending through its center. Motor 46 is any device that can apply driving force to a shaft, such as motor shaft 48, thereby generating a molten metal stream. Motor drive shaft 48 has a first end 48A, a second end 48B and a gas-transfer passage 48C (also called the motor-shaft passage) extending therebetween. A rotor drive shaft 50 (best seen in FIGS. 2, 3, 4 and 4A) has a first end 50A, a second end 50B and a gas-transfer passage 50C (also called the rotor-shaft passage) extending therebetween. First end 50A is connected to second end 48B of motor shaft 48 so that motor shaft 48 can drive rotor shaft 50 (this connection is preferably accomplished by a coupling 100, which is described in greater detail below).

Base 22, rotor 200, rotor drive shaft 50, support posts 42, and all components that come into contact with the molten metal are preferably comprised of oxidation-resistant graphite although any material suitable for the environment in which device 10 operates may be used. For example, all graphite components described herein could instead be formed of refractory material, refractory referring to any ceramic that would function in a molten metal environment.

Figure 4:
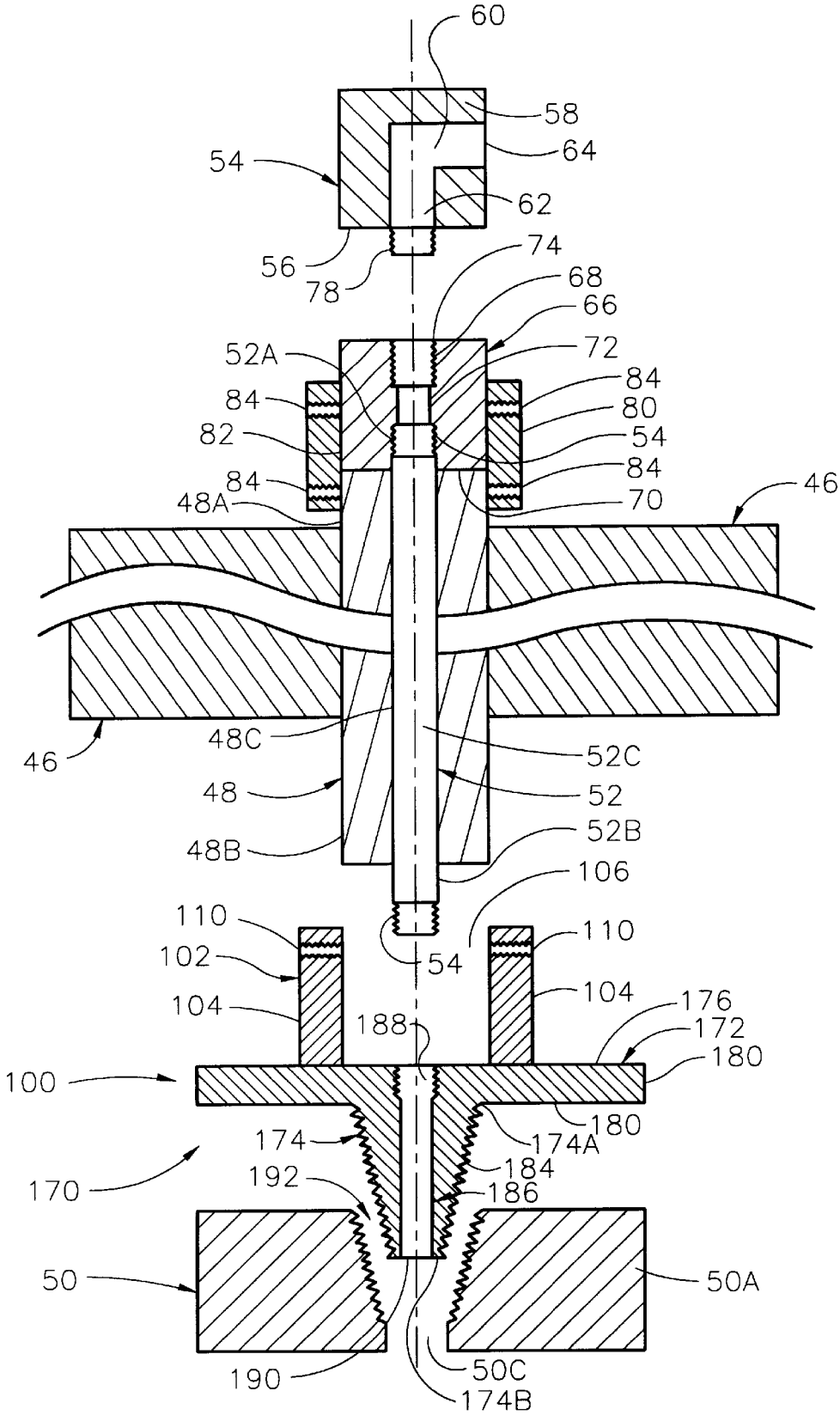
FIG. 4 is a partial cross-sectional schematic view of the device shown in FIG. 2.
Figure 4A:
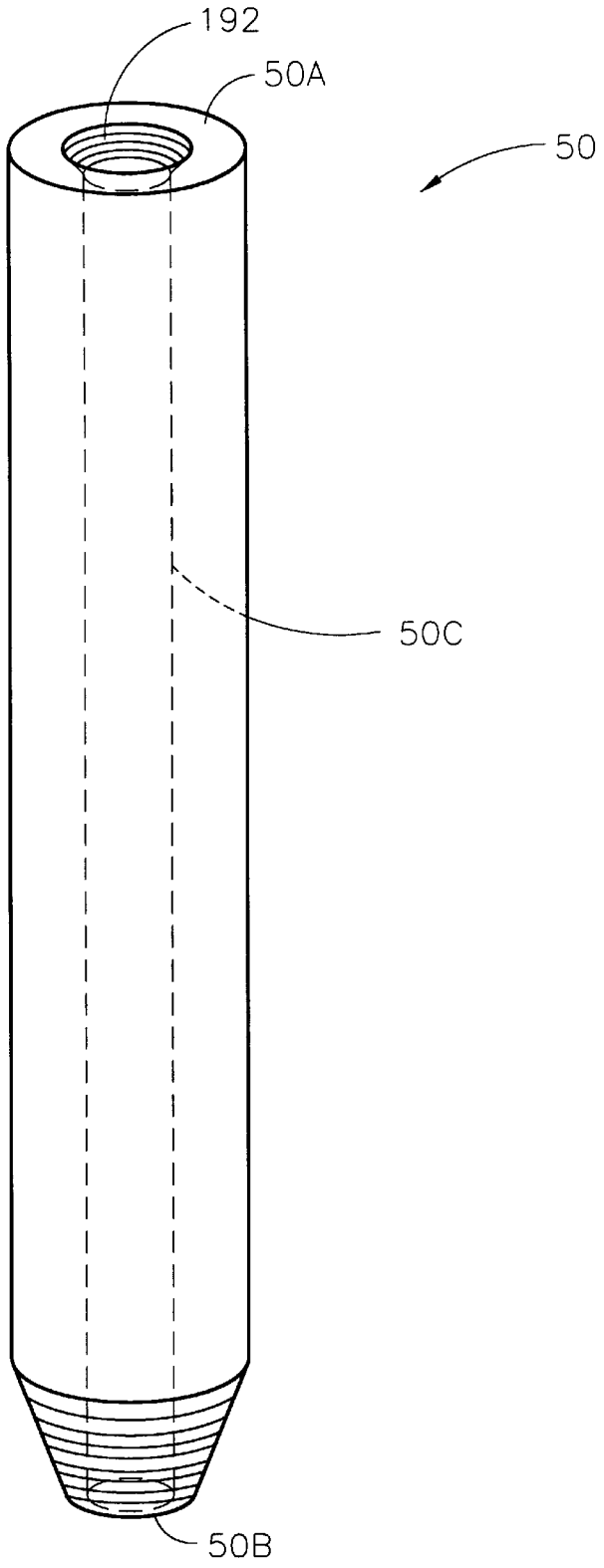
FIG. 4A is a perspective view of rotor shaft in accordance with the invention.
Figure 4B:
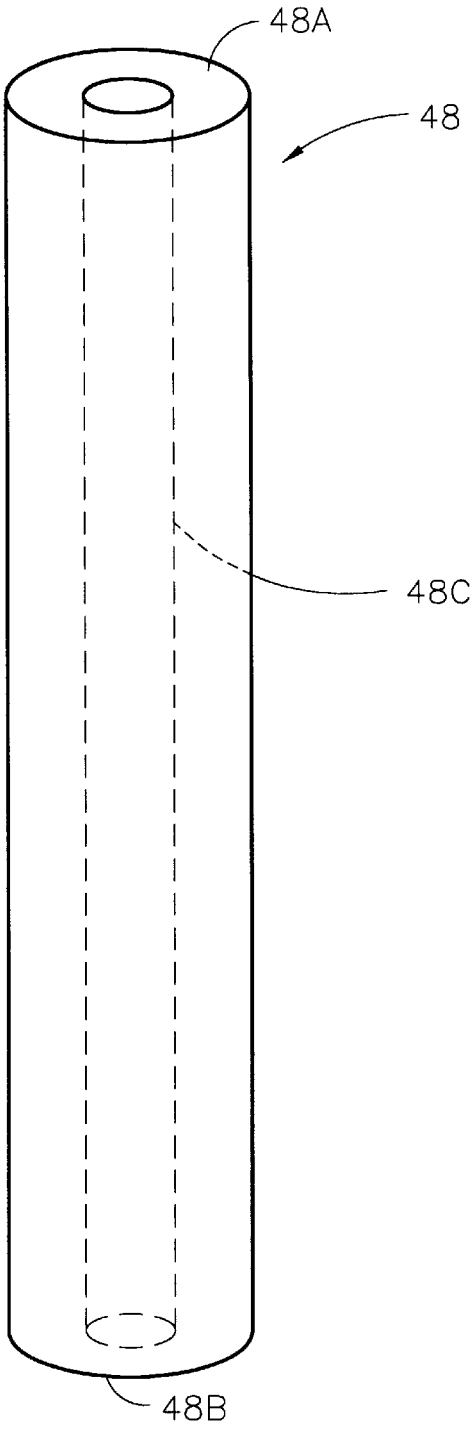
FIG. 4B is a side view of a motor shaft in accordance with the invention.
Figure 4C:
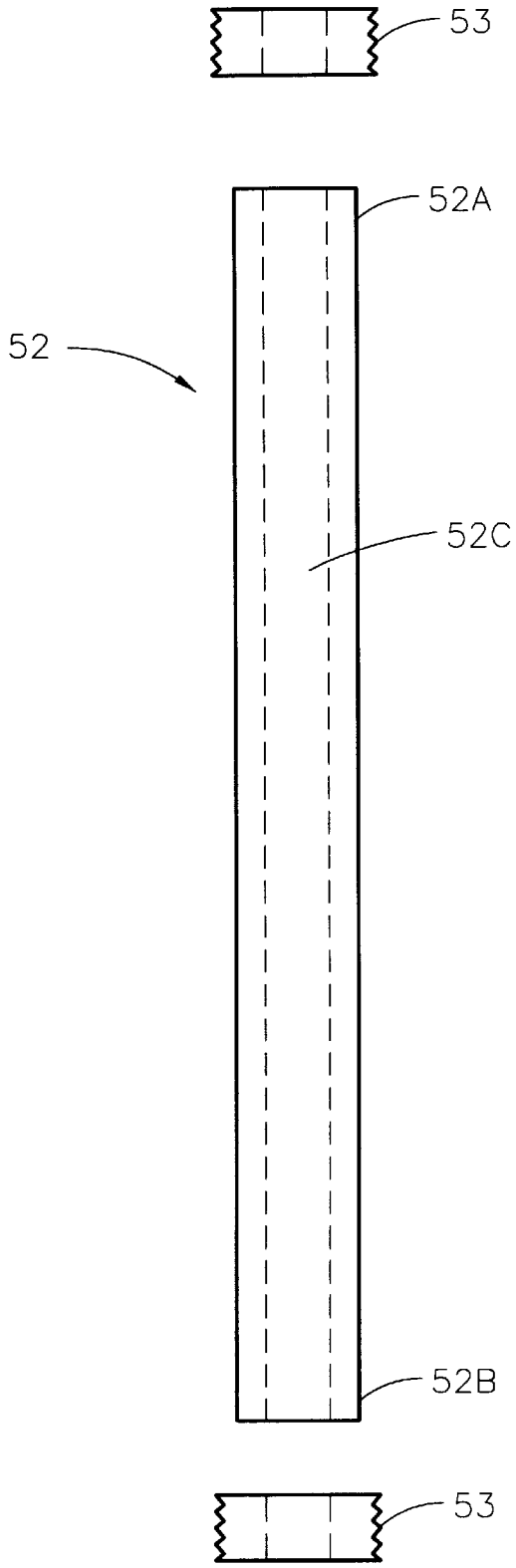
FIG. 4C is a side view of a hose and threaded fittings that can be used in accordance with the invention, wherein the hose may be positioned in the passage formed in the motor shaft.
Figure 4D:
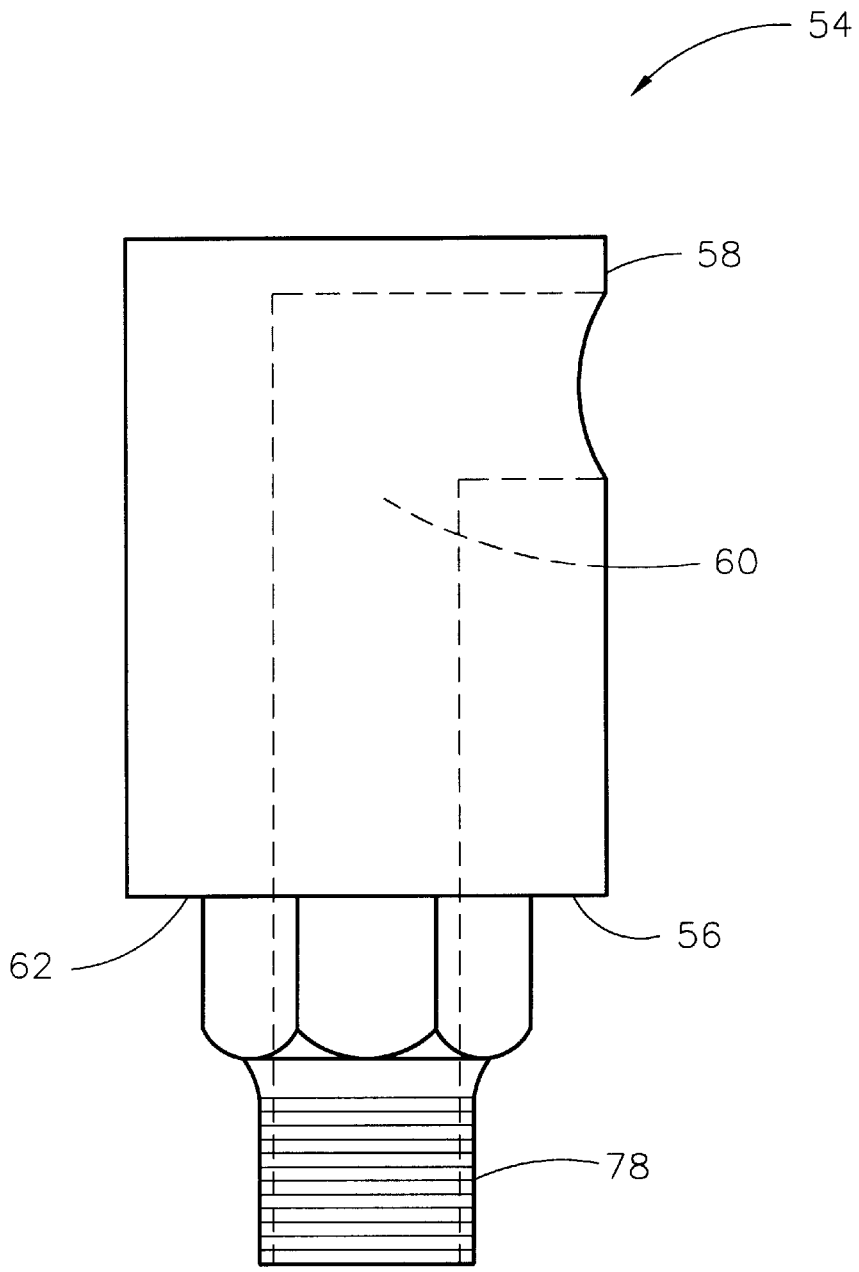
FIG. 4D is a side view of a rotary union that can be used with the invention.
Figure 5:
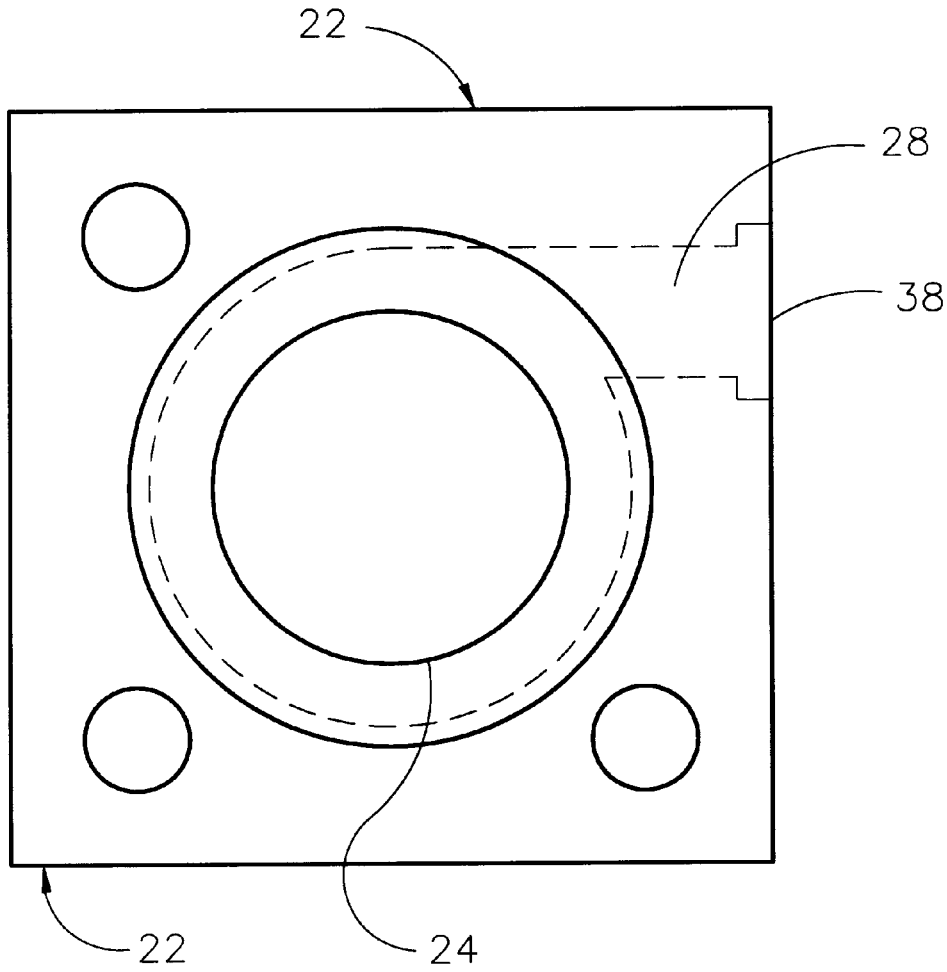
FIG. 5 is a plan view of the pump base shown in FIG. 2.

In the preferred embodiment, motor shaft 48 is designed to transfer gas as well as supply the drive for rotor shaft 50 and rotor 200. (Alternatively, gas may introduced directly into the motor shaft to rotor shaft coupling, directly into the rotor shaft or directly into the rotor.) As shown in FIGS. 4 and 4B, motor shaft 48 has first end 48A and second end 48B. Motor shaft 48 is preferably the standard shaft supplied with motor 46 except that a passage 48C is formed therethrough for transferring gas from end 48A to end 48B. Passage 48C is preferably a cylindrical bore formed in the center, and along the longitudinal axis, of motor shaft 48. End 48A extends outward from the top of motor 46. End 48B is opposite end 48A. Preferably a hose 52 (shown in FIGS. 4 and 4C) is inserted in passage 48C. Hose 52 is preferably formed of flexible stainless steel and has an end 52A that extends outward from end 48A and an end 52B that extends outward from end 48B. Preferably, a threaded fitting 53 is affixed to each end 52A and 52B of hose 52. Hose 52 includes a passage 52C extending therethrough.

A rotary union 54 has a rotating portion 56 and a stationary portion 58, which are shown schematically in FIG. 4, and shown in FIG. 4B. The purpose of rotary union 54 is to connect a stationary gas source to a moving drive shaft, including a gas-transfer passage which is preferably motor shaft 48 including passage 48C. A bore 60 extends from portion 56 to portion 58. Bore 60 includes an end 62 at rotating portion 56 and a threaded opening 64, or stationary connection, at fixed portion 58. A threaded fitting 78, having an opening formed therethrough, is preferably formed as part of rotary union 54 and extends outward from end 62 at rotating portion 56 of rotary union 54. Rotary union 54 is an off-the-shelf component and the preferred embodiment is part number 1115-00-002 having specifications of: ⅜" NPT, RH Rotor, manufactured by Deublin Company, 2050 Norman Drive, West Waukegan, Ill., but any such component that performs the same function could be used.

A sleeve 66, which is preferably made of steel, has a first end 68, a second end 70 and a passage 72 formed therethrough. Passage 72 includes a threaded opening 74 at first end 68 and a threaded opening 76 at second end 70. Fitting 78 is threadingly received in opening 74 and thereby attaches sleeve 66 to rotating portion 56 and creates a gas-transfer passage between the two. A gas source (not shown) is connected to opening 64 at stationary portion 58 of rotary union 54. Therefore, rotary union 54 and sleeve 66 create a gas-transfer passage between the stationary gas source (not shown) and hose 52, which rotates with motor shaft 48. Any structures described herein that can transfer gas between them are said to "communicate" or be "in communication." For example, as described above, rotary union 54 and sleeve 66 are "in communication" because gas can be transferred from one to the other.

A collar 80 connects sleeve 66 to shaft 48 and transfers driving force between the two. Collar 80 is preferably cylindrical, made of steel and has a bore 82 formed therethrough. Bore 82 is dimensioned to receive sleeve 66 and shaft 48. Preferably, collar 80 is affixed to sleeve 66 and motor shaft 48 by a mechanical fastening device that provides for easy removal of collar 80. It is most preferred that openings 84 are provided to receive set screws (not shown) which tighten against sleeve 66 and motor shaft 48.

Figure 15:
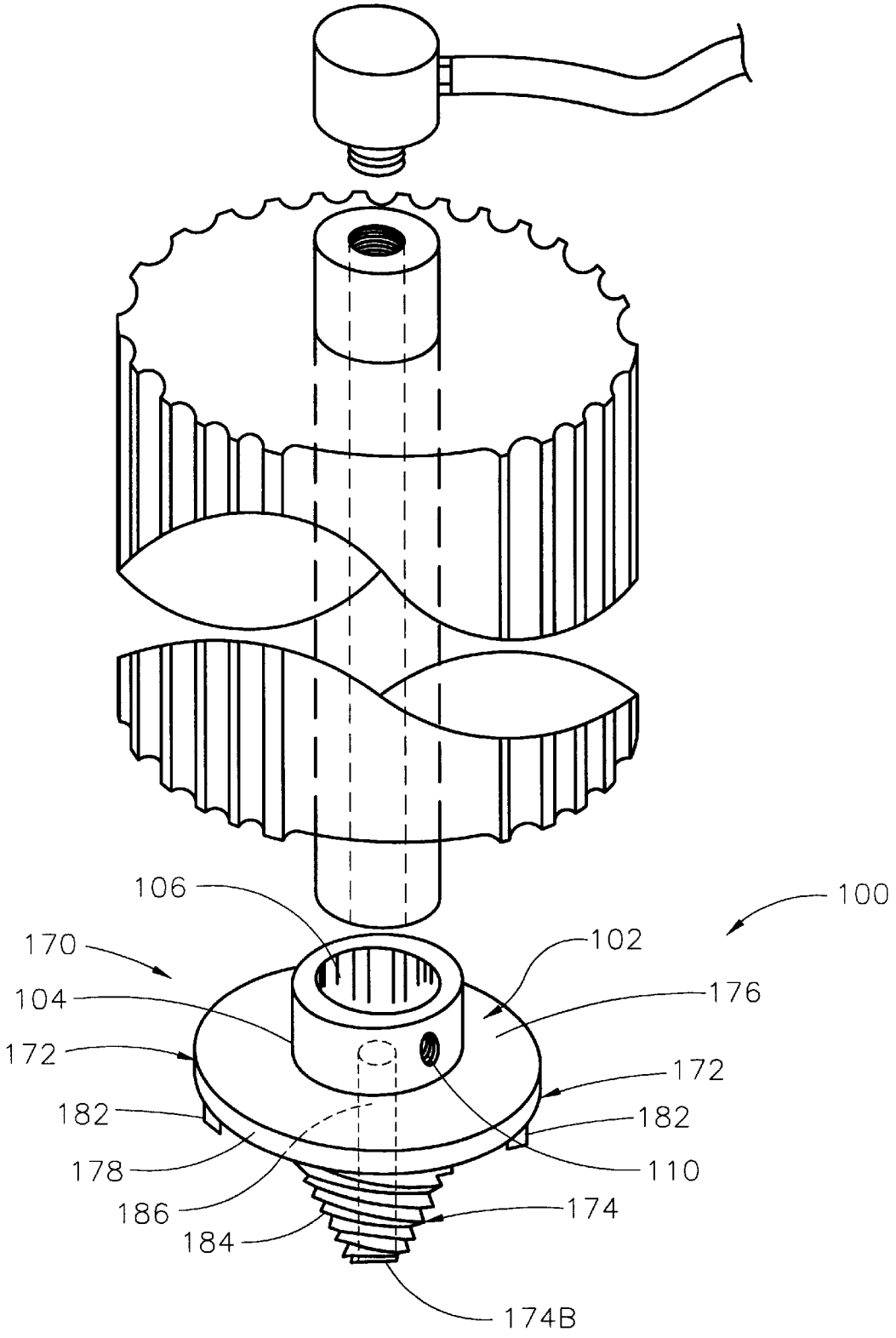
FIG. 15 is a perspective view of a motor shaft to rotor shaft coupling in accordance with the invention.

A coupling 100 is any structure capable of drivingly connecting motor shaft 48 and rotor shaft 50. An example of a preferred coupling member is shown in FIGS. 4 and 15.

Coupling 100 generally comprises a first coupling member 102, and a second coupling member 170, which are preferably welded to one another. Each coupling member 102 and 170 is preferably formed of metal and most preferably of steel. First coupling member 102 preferably comprises a cylindrical collar 104. Collar 104 has an opening 106 dimensioned to receive end 48B of motor drive shaft 48. Collar 104 has threaded apertures 110 (preferably three) radially spaced about its periphery. Apertures 110 threadingly receive bolts 112 when end 48B of motor shaft 48 is received in opening 108, and bolts 112 are tightened against the outer surface of motor shaft 48 to secure collar 104 to motor shaft 48. Alternatively, connective devices other than bolts 112 may be utilized.

A second coupling member 170 is preferably formed of steel and includes a flange portion 172 and a connective portion 174. Flange portion 172 is preferably circular and has a generally planar upper surface 176, an annular outer periphery 178 and a generally planar bottom surface 180. Connective portion 174 is integrally formed with, or connected to, bottom surface 180. Connective portion 174 extends outward from surface 180 and has a first end 174A at the intersection of portion 174 and surface 180, and a second end 174B distal surface 180. Portion 174 has a generally funnel-shaped outer surface 184 that gradually narrows moving from end 174A to end 174B. Outer surface 184 is preferably threaded. A passage 186 extends from surface 176 through portion 174 to second end 174B. Passage 186 includes an opening 188 at surface 176 and an opening 190 at second end 174B. Opening 188 is preferably threaded to receive fitting 53 on end 52B of hose 52.

As shown in FIG. 4, rotor shaft 50 further includes a tapered, threaded opening 192 in communication with rotor-shaft passage 50C. Opening 192 is dimensioned to threadingly receive connective portion 174.

Describing now the preferred manner in which a gas-transfer connection is made, coupling member 102, and hence, coupling 100 are secured to second end 48B of motor shaft 48 in the manner previously described. Fitting 53 on end 52B of hose 52 is then threadingly received in threaded opening 188 of second coupling member 170. Rotor shaft 50 is connected to connective portion 174 by connective portion 174 being threadingly received in opening 192.

Once coupling 100 is connected to motor shaft 48, end 52B of hose 52 and rotor shaft 50, a gas-transfer passage is established from rotary union 54, through sleeve 66, through motor shaft 48 (by passage 52C of hose 52), through coupling 100 and through rotor shaft 50. The invention, however, encompasses the transfer of gas into pump chamber 24 by any shaft or combination of shafts or devices that include a gas-transfer passage and that extend into the pump chamber. For example, a single drive shaft having a gas-transfer passage with no coupling member could extend from motor 46 into pump chamber 24, or a single drive shaft having a gas-transfer passage could connect to a rotor outside of pump chamber 24, the rotor extending into pump chamber 24 and releasing gas therein through openings in the rotor that transfer gas from the gas-transfer passage in the shaft into the pump chamber.

Figure 9:
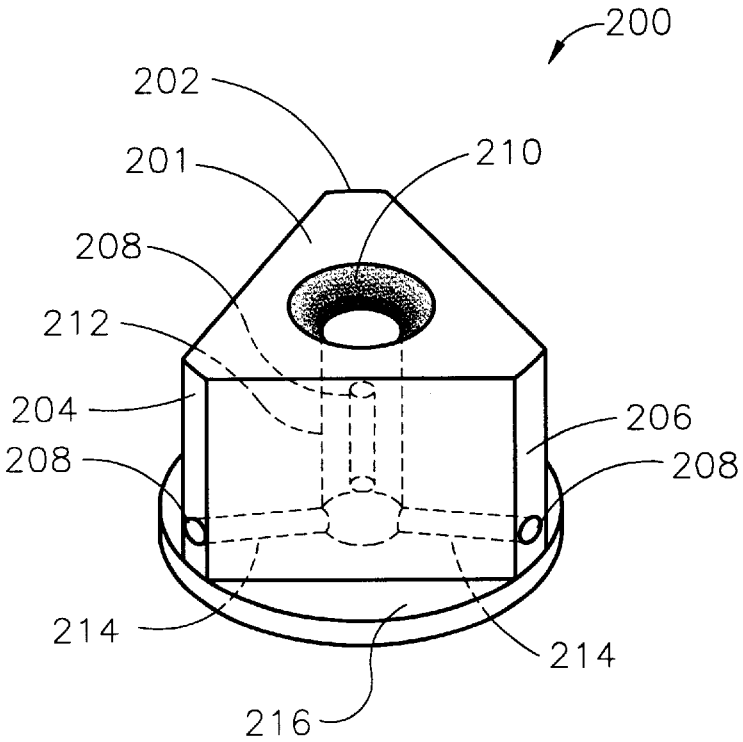
FIG. 9 is a perspective view of a rotor according to the invention.

A preferred rotor 200 is shown in FIG. 9. Rotor 200 is a solid, imperforate block, preferably formed of oxidation-resistant graphite. Rotor 200 is triangular in plan view, this shape being called trilobal. Three equally-sized lobes 202, 204 and 206, each having an opening 208, are formed as part of rotor 200. A connective section 210 is integrally formed with, or connected to, rotor 200 adjacent surface 210 and serves to connect end 50B of rotor shaft 50 to rotor 200. Preferably, section 210 is a tapered, threaded opening formed in a top surface 201 of rotor 200 that receives end 50B of shaft 50, end 50B preferably being tapered and threaded so as to be threadingly received in section 210. A passage 212 extends from connective section 210 into the interior of rotor 200. Passages 214 extend from openings 208 to passage 212. Passages 212 and 214 can be of any dimension and shape that allow for the transfer of gas between passage 50C of rotor shaft 50 and openings 208. A rotor base 216 is preferably circular and dimensioned to align with a bearing surface (not shown) at the bottom of pump casing 22. The purpose of base 216 is to align rotor 200 within chamber 24. Alternatively, rotor 200 may not include base 216 but would instead include a similar structure adjacent surface 211 to align rotor 200 within chamber 24; the inlet in such an arrangement would be at the bottom of pump housing 22. The invention, therefore, covers both top feed and bottom feed pumps.

Figure 10:
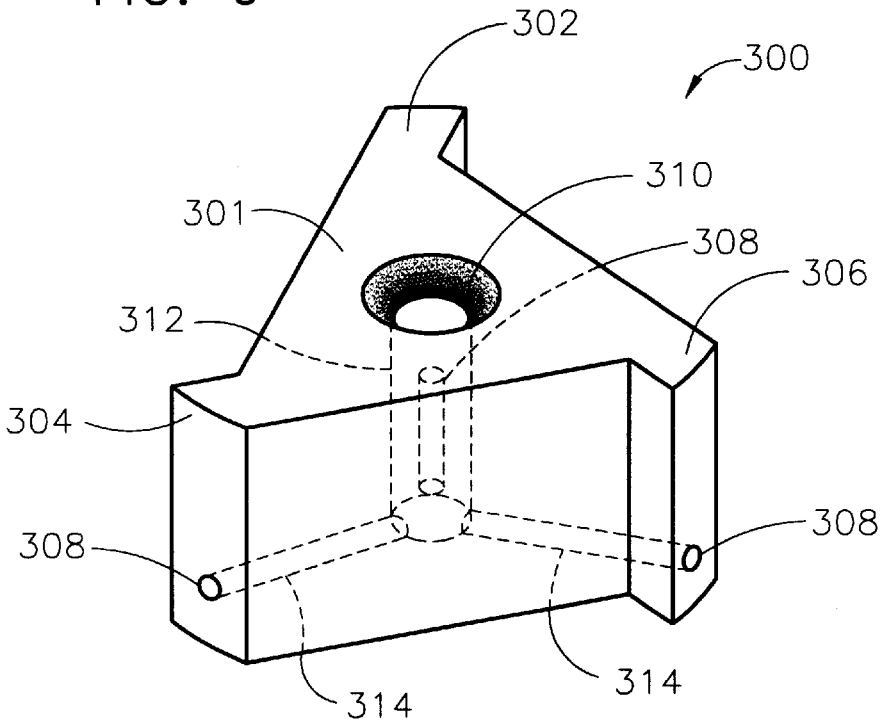
FIG. 10 is a perspective view of an alternate embodiment of a rotor according to the invention.
Figure 9A:
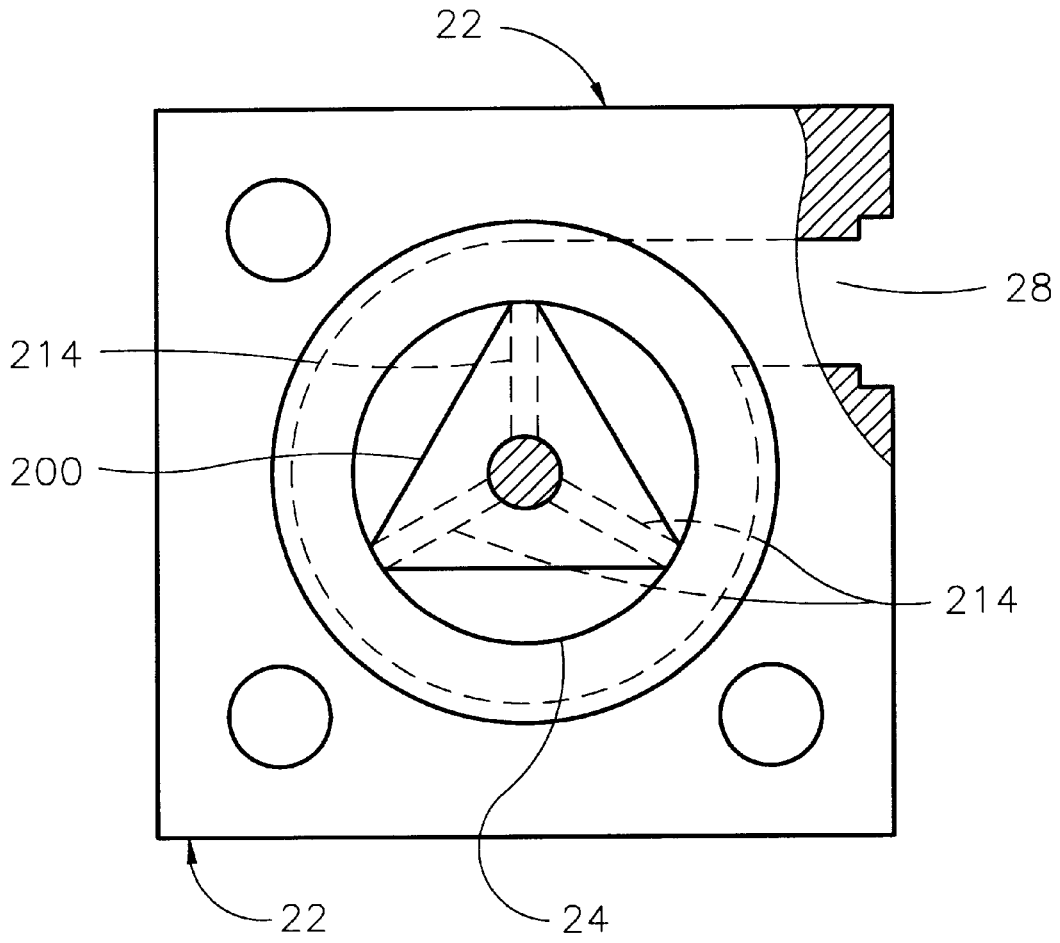
FIG. 9A is a plan view of the rotor shown in FIG. 9 positioned in a pump casing.
Figure 11:
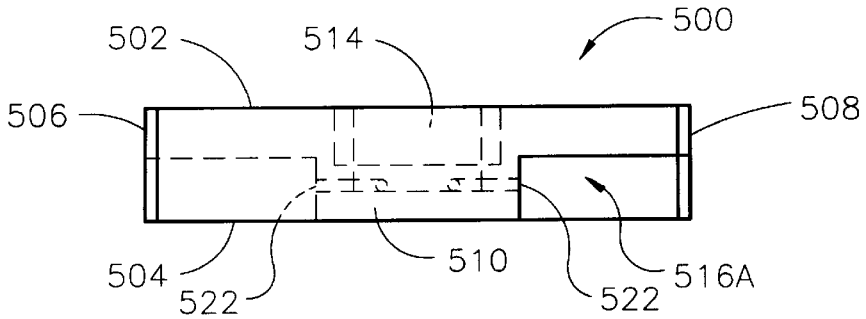
FIG. 11 is a side view of an alternate embodiment of a rotor according to the invention.
Figure 12:
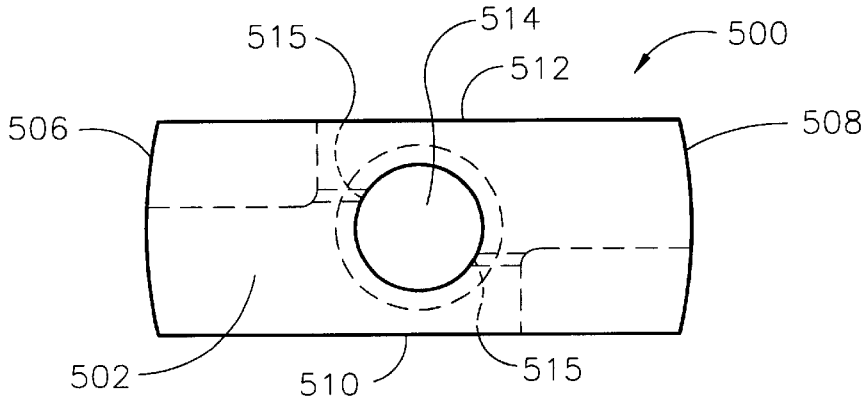
FIG. 12 is a top view of the rotor embodiment shown in FIG. 11.
Figure 13:
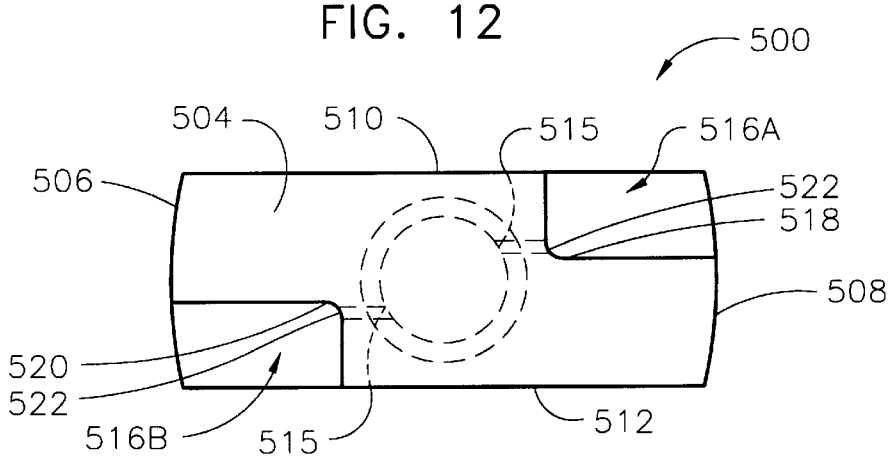
FIGS. 13 is a bottom view of the rotor embodiment shown in FIG. 11.
Figure 14:
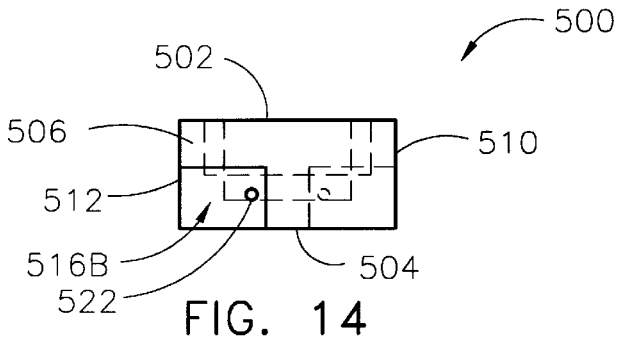
FIG. 14 is an end view of the rotor embodiment shown in FIG. 11.

An alternate rotor 300 is shown in FIG. 10. Rotor 300 has three vanes 302, 304, 306 each having an opening 308 formed therein. A connective section 310 is integrally formed with, or connected to, rotor 300 and serves to connect second end 50B of rotor shaft 50 to rotor 200. Preferably, connective section 310 is a tapered, threaded opening formed in a top surface 301 of rotor 300. A passage 312 extends from connective section 310 into the interior of rotor 300. Passages 314 extend from openings 308 to passage 312. As shown, rotor 300 does not have a base and is to be used with a dual-inlet pump housing. Passages 312 and 314 can be of any dimension and shape that allow for the transfer of gas between passage 50C of rotor 50 and openings 308.

Turning now to FIGS. 11–14 another alternate rotor, or impeller block, 500 in accordance with the present invention is shown. Impeller block 500 is generally rectangular in shape and is preferably comprised of graphite impregnated with an oxidation resistant solution, although other materials may be used. Block 500 has a top surface 502, a bottom surface 504, a first end 506, a second end 508, a first side 510 and a second side 512.

Top surface 502 includes a bore 514 formed therein. Bore 504 is preferably cylindrical and threaded. Gas inlets 515 are formed in bore 504 and form a preferably cylindrical passageway through block 500. Gas inlets 515 are preferably 1/32" to 3/8" in diameter.

Metal-transfer recesses 516A and 516B are formed in block 500. Recess 516A is formed between end 508 and side 510 and recess 516B is formed between end 506 and side 512. Each recess 516A and 516B has a generally rectangular opening. The exact size of the recesses will depend upon the size of impeller block 500 and the dimension of pump chamber 24. Inside corners 518 and 520 are radiused so that metal and gas do not clog (i.e., so there is no cavitation in) the corners of the recesses.

A gas-release opening 522 is formed at each corner, 518, 520, of metal-transfer recesses 516A and 516B. Openings 522 are preferably cylindrical and 1/32" to 3/8" in diameter although other shapes and sizes could be used. Furthermore, openings 522 need not be formed at the corners 518, 520 of recesses 516A and 516B, this merely being a preferred embodiment. Openings 522 may be formed at any location within recesses 516A, 516B. (Alternatively, the gas may exit the second end of rotor shaft 50 and be released under the rotor.) Additionally, openings 522 may contain a porous plug of ceramic or other suitable material through which the gas would effuse and this arrangement would also be referred to an opening. It is also possible that more than one gas release opening 522 be formed in each respective recess, 516A and 516B.

In another embodiment not shown in the drawings, block 500 has one or more opening(s) formed in bottom surface 504 that communicates with opening 514. This embodiment may include one or more channels formed in bottom surface 504 of block 500 wherein the channel(s) communicate with recesses 516A and 516B.

In either embodiment of block 500 discussed above, block 500 may alternatively only contain one metal-transfer recess or block 500 may have more than two ends and each end could then contain a metal-transfer recess, in which case block 500 would have more than two recesses. Other impeller blocks that may be used to practice the invention are disclosed in U.S. Pat. No. 5,678,807 to Cooper, entitled "Rotary Degasser," the disclosure of which is incorporated herein by reference.

Figure 1A:
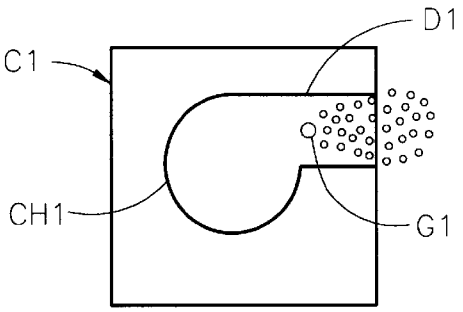
FIGS. 1A–1D are block diagrams of pump casings in plan view showing devices not in accordance with the invention.
Figure 1C:
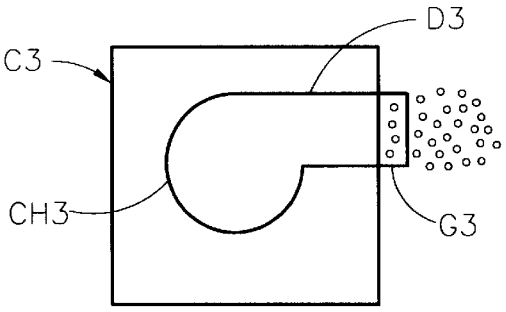
Figure 1E:
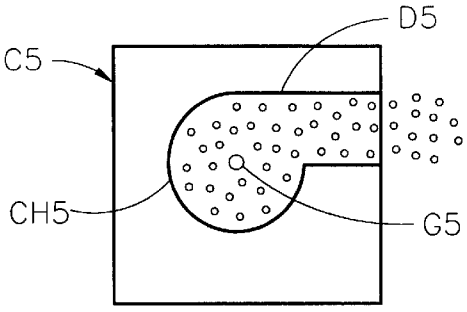
FIGS. 1E and 1F are block diagrams of pump casings in plain view showing devices in accordance with the invention.
Figure 1B:
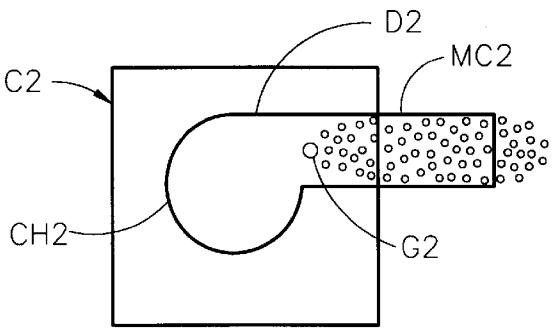
Figure 1D:
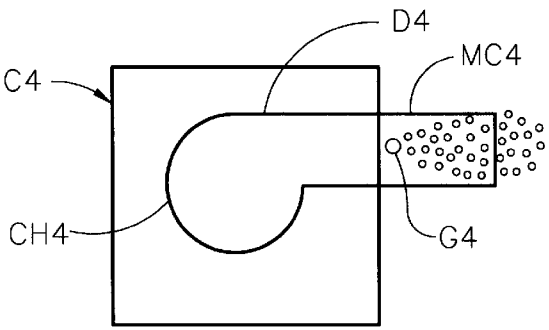
Figure 1F:
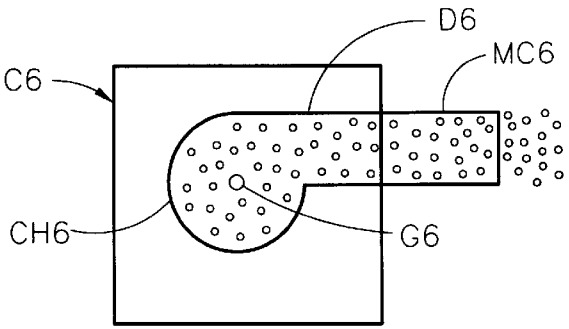
Figure 6:
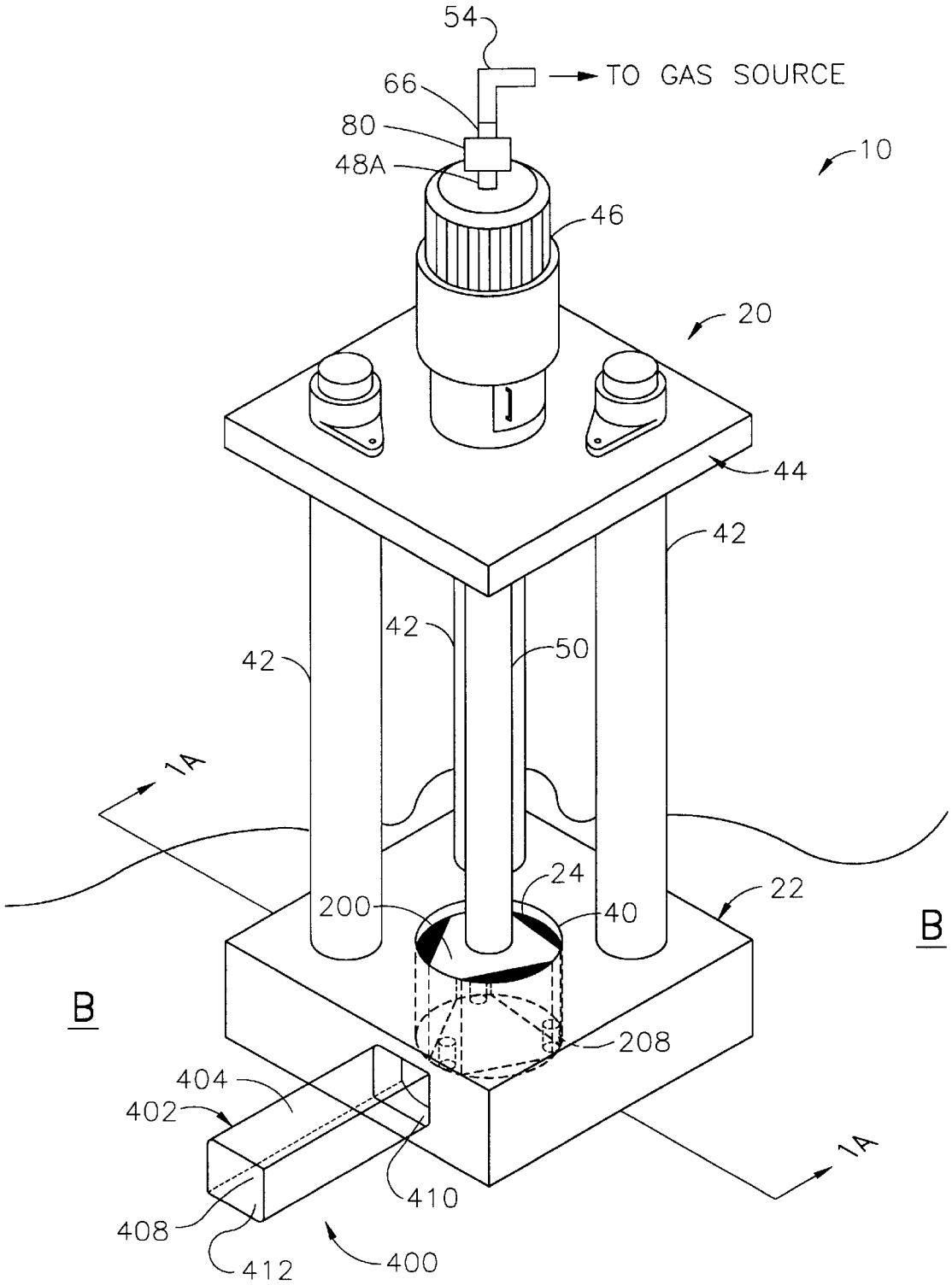
FIG. 6 is a perspective view of the gas-dispersion device shown in FIG. 2, further including a metal-transfer conduit extending from the discharge.
Figure 7:
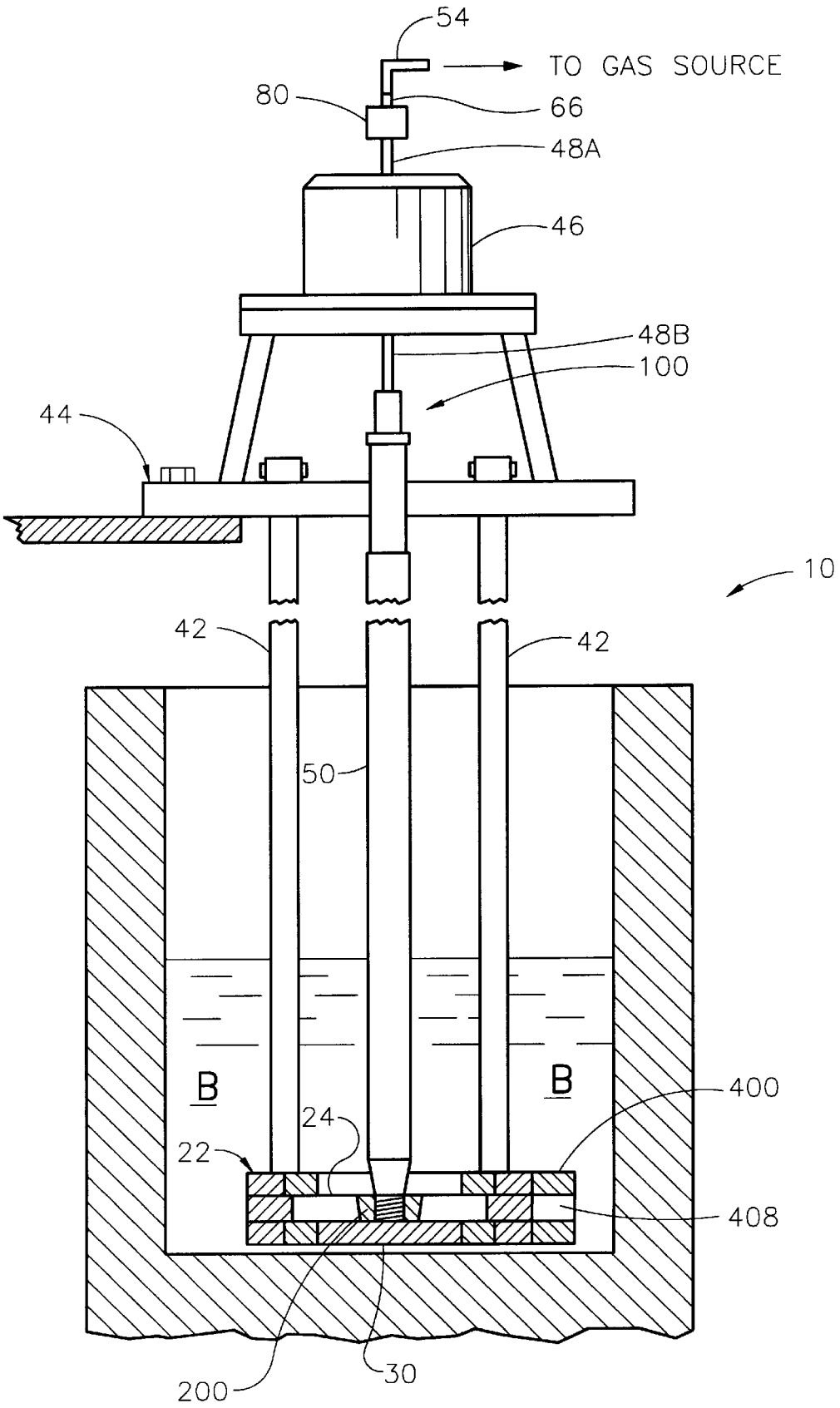
FIG. 7 is a partial, cross-sectional front view of the device shown in FIG. 6 with the motor cooling shroud removed.
Figure 8:
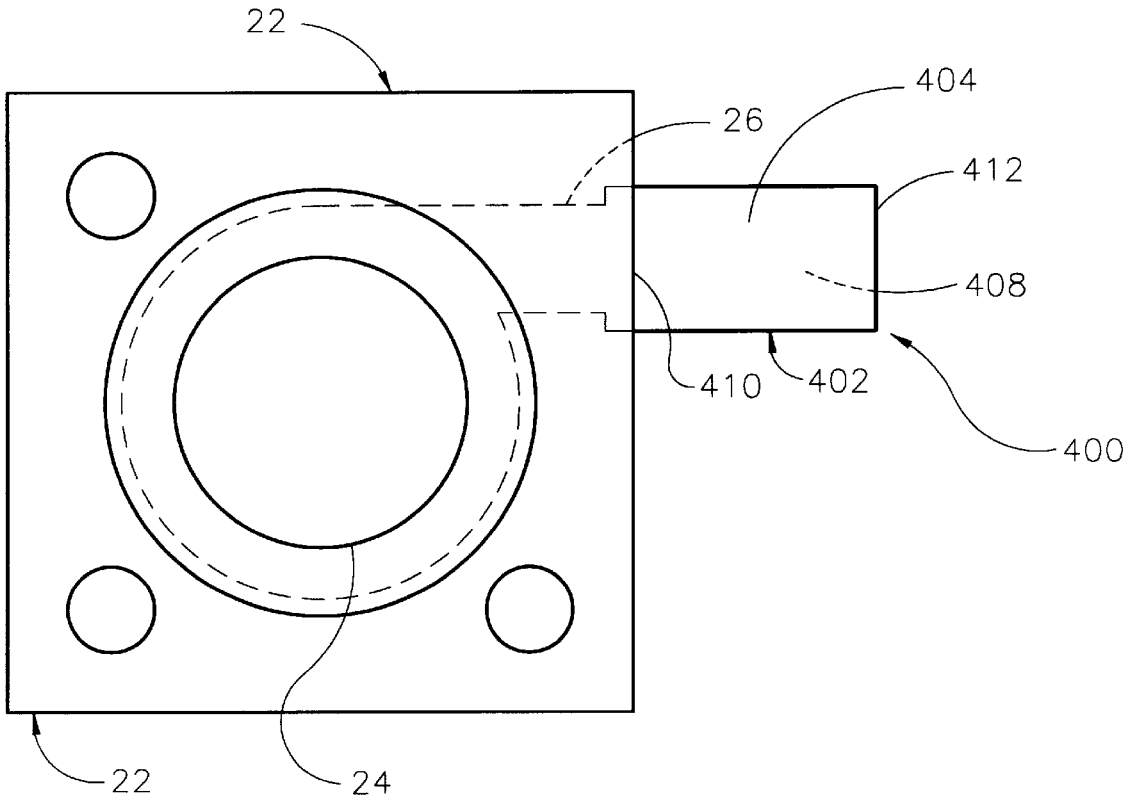
FIG. 8 is a plan view of the pump base shown in FIG. 6.

Another embodiment of the invention is shown in FIGS. 6–8, and is schematically illustrated in FIG. 1E, wherein a system is shown that includes a metal-transfer device 400 connected to, or otherwise extending from, outlet 38 of discharge 26. As used herein, the term metal-transfer device refers to any totally-enclosed or partially-enclosed structure which can, at least partially, contain a molten metal stream or flow. The enclosed portion of the metal-transfer device which contains the molten metal flow is hereinafter referred to as a channel. Some preferred shapes of a metal-transfer device 400 of the present invention are semi-circular, u-shaped, v-shaped, circular, rectangular, square or 3-sided with an open bottom. It will be understood that, if the metal-transfer device is open on one side, for example, if the metal-transfer device is u-shaped, semi-circular, v-shaped or 3-sided, the open side faces downward. Furthermore, the metal-transfer device may include baffles that break the molten metal stream into two or more separate streams traveling through two or more channels defined within the metal-transfer device. The metal-transfer device may be (a) attached to the outlet of a pump, (b) formed as part of a pump base and extend from the outlet, or (c) a separate structure from the pump base and not be attached to, but instead simply be positioned so that the channel can communicate with, the outlet. The term communicate, when used in this context, means that at least part of the molten metal stream exiting the discharge enters the channel defined by the metal-transfer device. Metal-transfer device 400 is preferably a metal-transfer conduit 402 having an upper wall 404, a channel 408, an inlet 410 and an outlet 412. Conduit 402 preferably has a length of 12–48 inches. Some metal-transfer devices and conduits that may be used to practice the invention are disclosed in U.S. Pat. No. 5,662,725 to Cooper, the disclosure of which is incorporated herein by reference.

In operation, device 10 creates a molten metal stream as motor drive shaft 48 drives coupling 100 which causes rotor shaft 50 and impeller 200 to rotate. This stream moves through discharge 26, outlet 38, and through channel 406 of metal-transfer device 400, moving from inlet 410 to outlet 412. A gas source (not shown) provides gas to first opening 64 of bore 60 of rotary union 54. The gas travels through bore 60, and passes through fitting 78, through opening 74 and bore 72 of sleeve 66, into end 52A of hose 52, through passage 52C and end 52B, through the passage in coupling 100, into passage 50C of rotor shaft 50, into passages 212 and 214 of rotor 200 and is released through openings 208 into the molten metal in chamber 24.

If rotor 500 is used, the gas enters opening 514 and gas inlet(s) 515 and escapes through gas-release opening(s) 522. The gas is dispersed into the molten metal and the molten metal with the gas dispersed therein is pushed outward and through discharge 78.

If a block 500 having one or more openings in bottom surface 504 is used the gas travels through passageway 50C, escapes through an opening in second end 50B of rotor shaft 50 and exits out of the openings in surface 504. Alternatively, rotor shaft 50 may extend through the opening in surface 504 and gas is released into chamber 24 through the opening in end 50B of rotor shaft 50 and/or the opening in surface 504. Block 500 is rotating and recesses 516A and 516B physically cut or shear the gas rising from beneath block 500 thus forming small bubbles that are dispersed into the molten metal in contact with the recesses 516A and 516B. The molten metal containing the dispersed gas is then conveyed into discharge 26.

Having now described preferred embodiments of the invention, other variations and embodiments that do not depart from the spirit of the invention will become apparent to those skilled in the art. The scope of the present invention is thus not limited to any one particular embodiment, but is instead set forth in the appended claims and the legal equivalents thereof.

What is claimed is:

1. A pump for pumping molten metal, said pump comprising:

(a) a motor;

(b) a housing having a pump chamber leading to a discharge;

(c) a motor shaft driven by said motor, said motor shaft having a first end and a second end, said first end of said motor shaft connected to said motor;

(d) a rotor shaft having a first end and a second end, said second end of said rotor shaft positioned in said pump chamber, said first end of said rotor shaft connected to said second end of said motor shaft;

(e) a rotor connected to said second end of said rotor shaft; and (f) a rotor-shaft passage extending from said first end of said rotor shaft to said second end of said rotor shaft;

whereby gas is introduced into said rotor-shaft passage at said first end of said rotor shaft, said gas being released from said rotor-shaft passage at said second end of said rotor shaft and into said pump chamber.

2. A pump as defined in claim 1 which further includes a gas source connected to said first end of said rotor shaft so as to transfer gas into said rotor-shaft passage.

3. A pump as defined in claim 1 wherein said motor shaft has a motor-shaft passage extending between said first end of said motor shaft and said second end of said motor shaft, said motor-shaft passage communicating with said rotor-shaft passage, gas being introduced into said rotor-shaft passage through said motor-shaft passage.

4. A pump as defined in claim 3 which further includes a gas source connected to said first end of said motor shaft so as to transfer gas into said motor-shaft passage.

5. A pump as defined in claim 3 which further includes a hose positioned in said motor-shaft passage, said hose communicating with said rotor-shaft passage.

6. A pump as defined in claim 5 wherein said hose has a first end extending from said first end of said motor shaft and a second end extending from said second end of said motor shaft, said first end of said hose connected to a gas source and said second end of said hose connected to said rotor shaft.

7. A pump as defined in claim 6 which further includes a rotary union having a rotating connection and a stationary connection and an opening therebetween, said rotating connection attached to said first end of said hose, said stationary connection of said rotary union connected to a gas source, said first end of said hose thereby being connected to said gas source by said rotary union.

8. A pump as defined in claim 1 wherein said rotor has an opening formed therein, said opening in communication with said rotor-shaft passage and in communication with said pump chamber, whereby gas is transferred from said rotor-shaft passage into said opening and is released into said pump chamber.

9. A pump as defined in claim 3 wherein said rotor has an opening formed therein, said opening in communication with said rotor-shaft passage and in communication with said pump chamber, whereby gas is transferred from said rotor-shaft passage into said opening and is released into said pump chamber.

10. A pump as defined in claim 8 wherein said rotor has a plurality of openings, each of which is in communication with said passage in said rotor shaft and in communication with said pump chamber, whereby gas is transferred from said passage in said rotor shaft to said openings and is released into said pump chamber.

11. A pump as defined in claim 8 wherein said rotor is trilobal.

12. A pump as defined in claim 10 wherein said rotor is trilobal and each lobe of said trilobal rotor has an opening.

13. A pump as defined in claim 1 that further includes a coupling that drivingly connects said motor shaft and said rotor shaft, said coupling including a passage for transferring gas from said motor-shaft passage to said rotor-shaft passage.

14. A pump as defined in claim 1 which further includes a metal-transfer device extending from said pump discharge.

15. A rotor shaft for use in a molten metal pump having a pump chamber, the rotor shaft having a first end including a threaded opening connectable to a coupling, a second end connectable to a rotor positioned within the pump chamber, and a gas-transfer passage therein.

16. A rotor shaft as defined in claim 15 which is comprised of graphite.

17. A rotor shaft as defined in claim 15 wherein said end connectable to a rotor is externally threaded.

18. A method for dispersing gas into molten metal, said method including the steps of:

(a) providing a pump for pumping molten metal, said pump comprising:
  (i) a pump housing having a pump chamber and a discharge extending from said chamber;
  (ii) a motor;
  (iii) a drive shaft drivingly connected to said motor, said drive shaft including a passage for transferring gas; and
  (iv) a rotor connected to an end of said drive shaft opposite said motor, said rotor positioned at least partially within said pump chamber, said rotor including one or more openings in communication with said passage and in communication with said pump chamber; and (b) providing a bath of molten metal;

(c) providing a gas source;

(d) placing said pump into said bath of molten metal;

(e) connecting said gas source to said passage;

(f) operating said motor to turn said drive shaft and said rotor to generate a stream of molten metal passing through said discharge; and (g) introducing gas into said passage, said gas traveling through said passage and through said one or more openings into said pump chamber.

19. A method as defined in claim 18 wherein said gas is chlorine.

20. A method as defined in claim 18 wherein said gas is selected from the group consisting of argon, nitrogen and freon.

21. A method as defined in claim 18 wherein said gas is a mixture of chlorine and the group consisting of argon, nitrogen and freon.

22. A method as defined in claim 18 wherein said pump further includes a metal-transfer device extending from said discharge.

23. A method as defined in claim 18 wherein said drive shaft comprises a motor drive shaft connected to said motor and a rotor drive shaft having a first end connected to said motor drive shaft and a second end connected to said rotor, said motor drive shaft including a motor-shaft passage and said rotor drive shaft including a rotor-shaft passage, said motor-shaft passage in communication with said rotor-shaft passage.

24. A method as defined in claim 23 wherein said motor shaft is connected to said rotor shaft by a coupling.

25. A method as defined in claim 19 wherein said rotor is triolobal.

26. A method for dispersing gas into molten metal, said method including the steps of:

(a) providing a pump for pumping molten metal, said pump comprising:
  (i) a pump housing having a pump chamber and a discharge extending from said chamber;
  (ii) a motor;
  (iii) a drive shaft drivingly connected to said motor, said drive shaft including a passage for transferring gas and having an end opposite said motor; and
  (iv) a rotor connected to said end of said drive shaft opposite said motor, said rotor positioned at least partially within said pump chamber;

(b) providing a bath of molten metal;

(c) providing a gas source;

(d) placing said pump into said bath of molten metal;

(e) connecting said gas source to said passage;

(f) operating said motor to turn said drive shaft and said rotor to generate a stream of molten metal passing through said discharge; and (g) introducing gas into said passage, said gas traveling through said passage and escaping into said pump chamber.

27. A method as defined in claim 26 wherein said gas is released under said rotor.

28. A method as defined in claim 26 wherein said rotor further includes one or more openings in communication with said passage, and in communication with said pump chamber the gas traveling through said passage, through said openings and into said pump chamber.

29. A method as defined in claim 26 wherein said drive shaft comprises (a) a motor shaft having a first end connected to said motor, a second end, and a passage therethrough, and (b) a rotor shaft having a first end connected to said second end of said motor shaft, a second end connected to said rotor and a passage therethrough, said passage in said motor shaft in communication with said passage in said rotor shaft.

30. A method as defined in claim 26 wherein said second end of said motor shaft is connected to said first end of said motor shaft by a coupling.

* * * * *